US007828239B2

(12) United States Patent
Ito

(10) Patent No.: US 7,828,239 B2
(45) Date of Patent: Nov. 9, 2010

(54) PAPER FEEDING DEVICE

(75) Inventor: Akihiko Ito, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/315,637

(22) Filed: Dec. 4, 2008

(65) Prior Publication Data

US 2009/0152793 A1 Jun. 18, 2009

(30) Foreign Application Priority Data

Dec. 14, 2007 (JP) ..... 2007-323597

(51) Int. Cl.
*B65H 26/00* (2006.01)

(52) U.S. Cl. ..... 242/563; 242/598.3

(58) Field of Classification Search ..... 242/598, 242/598.3, 598.4, 598.5, 599.3, 563; 400/708
See application file for complete search history.

(56) References Cited

U.S. PATENT DOCUMENTS 4,277,034 A * 7/1981 Buzzell ..... 242/598.3
5,302,037 A * 4/1994 Schoendienst et al. ..... 400/589
5,374,007 A * 12/1994 Murison ..... 242/598.3
5,725,321 A * 3/1998 Brannan et al. ..... 400/708
2003/0173451 A1 * 9/2003 Inana ..... 242/596.7

* cited by examiner

*Primary Examiner*—William A Rivera
(74) *Attorney, Agent, or Firm*—Adams & Wilks

(57) ABSTRACT

In order to enable a plurality of paper rolls having different diameters in an unused (new) state to be mounted freely according to a choice of a user, and to increase convenience for a user.

A paper feeding device 3 that feeds a sheet of a paper roll 2*a* (2*b*) to a printing device 4, includes two side plates 8*b* vertically arranged along both sides of the paper roll 2*a* (2*b*), in which the side plates 8*b* are provided with a plurality of notches 11, 13 which are capable of bearing-supporting the paper rolls 2*a* (2*b*) having the different diameters in the unused state, and in which, when the notches 11, 13 are mounted with the corresponding paper rolls 2*a* (2*b*) in the unused state, end portions 14, 15 of outer peripheral surfaces of the paper rolls 2*a* (2*b*) on the printing device 4 side are arranged to be positioned in substantially the same vertical plane.

9 Claims, 3 Drawing Sheets

PAPER FEEDING DEVICE

BACKGROUND OF THE INVENTION

1. Field of the Invention

The present invention relates to a paper feeding device that is used in a printer, which prints and issues a receipt, ticket, or the like using a sheet of a paper roll, and feeds the sheet of the paper roll to a printing device.

2. Description of the Related Art

As such a paper feeding device, for example, there is known a paper feeding device disclosed in Patent Document 1 (JP 05-345429 A).

However, in the paper feeding device disclosed in Patent Document 1, a paper roll holder which bearing-supports the paper roll accommodates only one kind of paper roll, in other words, only, for example, a paper roll having 4 inches diameter in an unused (new) state. Thus, when a user intends to change to a paper roll having a larger diameter (paper roll having 6 inches diameter, for example) in response to usage condition or the like, the paper roll having the larger diameter cannot be mounted to the paper roll holder, thereby causing a problem of bad usability.

SUMMARY OF THE INVENTION

The present invention has been made in view of the above, and therefore has an object to provide a paper feeding device in which a plurality of paper rolls having different diameters in an unused (new) state can be mounted freely according to a choice of a user, and can increase convenience for a user.

In order to solve the above-mentioned problem, the present invention adopts the following means.

A paper feeding device according to the present invention that feeds a sheet of a paper roll to a printing device, includes two side plates vertically arranged along both sides of the paper roll, in which the side plates are provided with a plurality of notches which are capable of bearing-supporting paper rolls having different diameters in an unused state, and in which, when the notches are mounted with corresponding paper rolls in the unused state, end portions of outer peripheral surfaces of the paper rolls on a printing device side are arranged to be positioned in substantially the same vertical plane.

In the paper feeding device according to the present invention, there are provided the plurality of notches which are capable of bearing-supporting the paper rolls having the different diameters in the unused (new) state, and hence the paper rolls having the different diameters in the unused (new) state can be mounted freely according to a choice of a user, whereby it is possible to increase the convenience for a user.

Further, when the notches are mounted with the corresponding paper rolls in the unused state, the end portions of the outer peripheral surfaces of the paper rolls on the printing device side are arranged to be positioned in the substantially same vertical plane, whereby it is possible to stably feed a paper sheet to the printing device located downstream even in the case of using any one of the paper rolls.

In the above-mentioned paper feeding device, it is further preferred that on any one of the side plates, there be arranged a near end sensor which detects a remaining amount of the paper roll, and there be provided grooves which slide the near end sensor in a radial direction of the paper rolls bearing-supported by the notches.

In the paper feeding device as described above, a user can set the near end sensor in a desired position easily and swiftly in accordance with the diameter of the paper roll selected appropriately as needed by solely moving the near end sensor along the grooves formed in the side plate.

In the above-mentioned paper feeding device, it is further preferred that the groove be formed such that distances between rotation centers of the paper rolls and a sensor portion of the near end sensor are the same when the near end sensor is brought closest to the rotation centers of the paper rolls, and the distances between the rotation centers of the paper rolls and the sensor portion of the near end sensor are the same when the near end sensor is furthest away from the rotation centers of the paper rolls.

In the paper feeding device as described above, a user can grasp the distances between the rotation centers of the paper rolls and the sensor portion of the near end sensor uniformly by solely positioning the near end sensor on an end of the grooves.

In the above-mentioned paper feeding device, it is further preferred that the grooves be connected through a groove portion which rotates the near end sensor along the side plate.

In the paper feeding device as described above, a user can set the near end sensor in a desired position easily and swiftly in accordance with the diameter of the paper roll selected appropriately as needed by solely moving the near end sensor along the grooves formed in the side plate without being detached from the side plate.

A printer according to the present invention includes the paper feeding device which is capable of freely mounting the paper rolls having the different diameters in the unused (new) state according to the choice of a user, whereby it is possible to increase the convenience for a user.

According to the present invention, the paper rolls having the different diameters in the unused (new) state can be mounted freely according to the choice of a user, thereby attaining an effect of increasing the convenience for a user.

BRIEF DESCRIPTION OF THE DRAWINGS

In the accompanying drawings:

FIGS. 2A-2D are views of one side plate of the paper feeding device illustrated in FIG. 1 when seen from a back side, in which: FIG. 2A is a view when a near end sensor is brought closest to a rotating shaft set to a second notch; FIG. 2B is a view when the near end sensor is furthest away from the rotating shaft set to the second notch; FIG. 2C is a view when the near end sensor is furthest away from the rotating shaft set to a first notch; and FIG. 2D is a view when the near end sensor is brought closest to the rotating shaft set to the first notch; and FIGS. 3A-3D are views of the one side plate of the paper feeding device illustrated in FIG. 1 when seen from a front side, in which: FIG. 3A is a view when a near end sensor is brought closest to a rotating shaft set to a second notch; FIG. 3B is a view when the near end sensor is furthest away from the rotating shaft set to the second notch; FIG. 3C is a view when the near end sensor is furthest away from the rotating shaft set to a first notch; and FIG. 3D is a view when the near end sensor is brought closest to the rotating shaft set to the first notch.

DETAILED DESCRIPTION OF THE PREFERRED EMBODIMENT

Hereinafter, an embodiment of a paper feeding device according to the present invention is described with reference to FIGS. 1 to 3A-3D.

Figure 1:
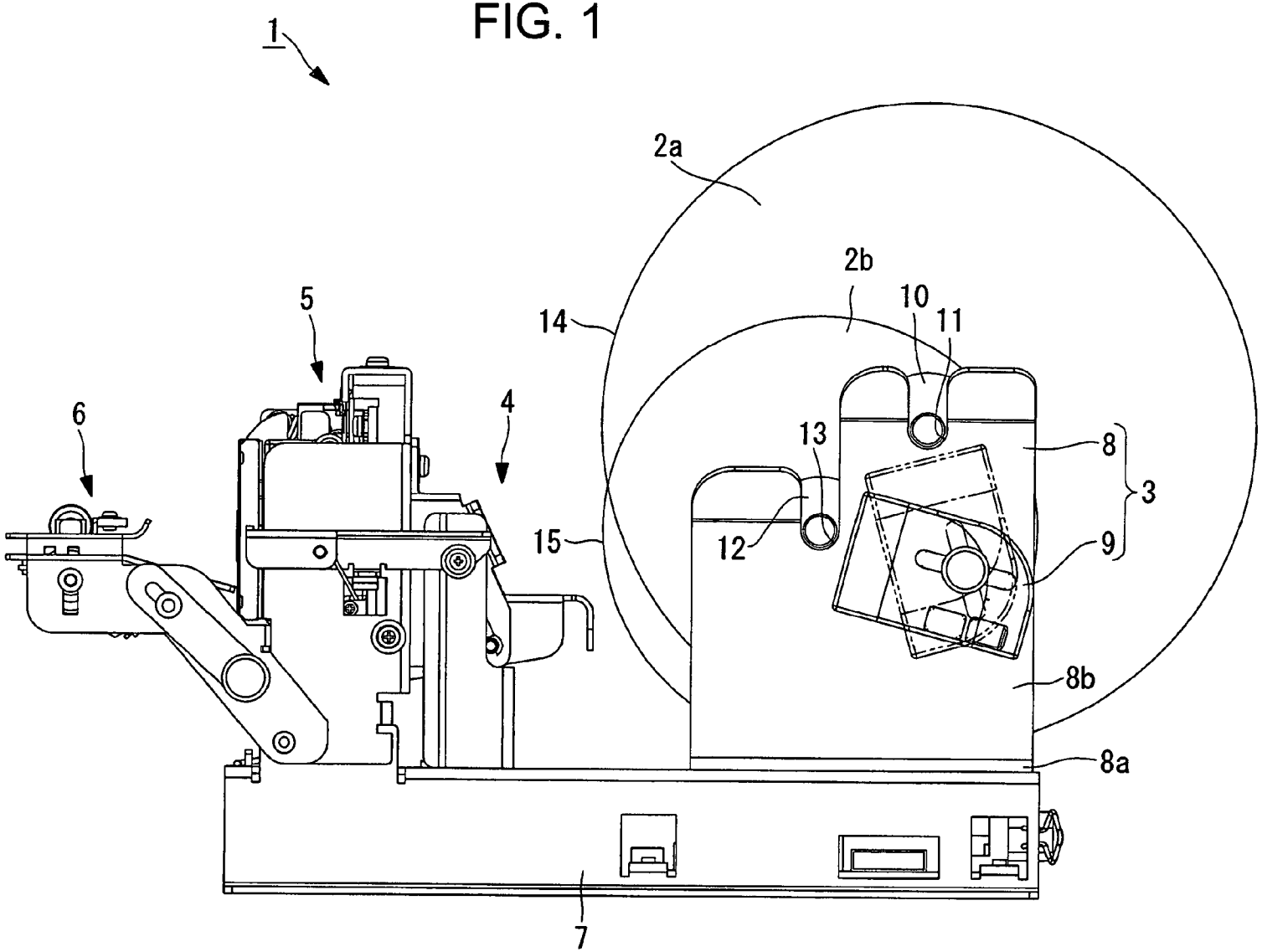
FIG. 1 is a side view of a printer provided with a paper feeding device according to an embodiment of the present invention.
Figure 2A:
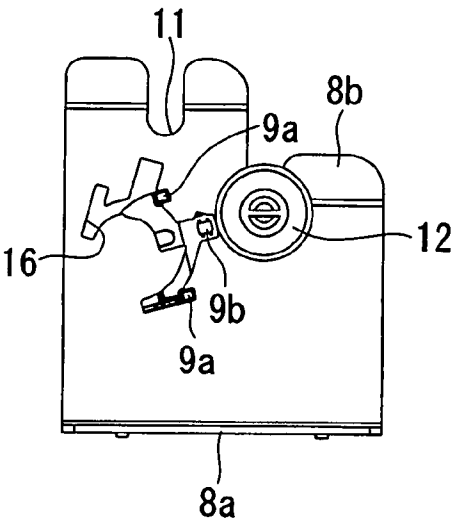
Figure 2B:
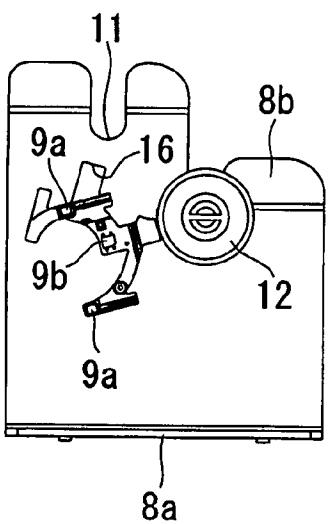
Figure 2C:
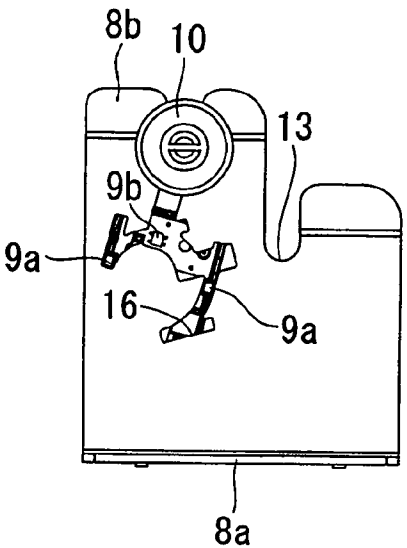
Figure 2D:
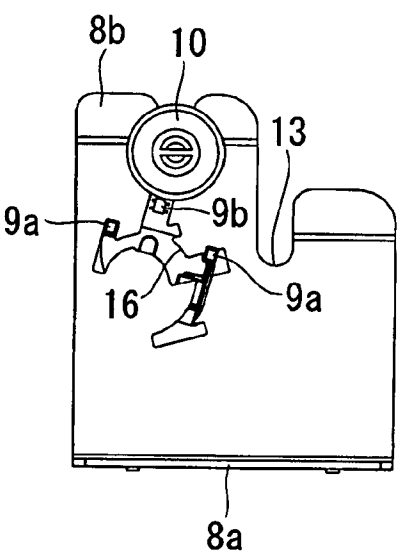
Figure 3A:
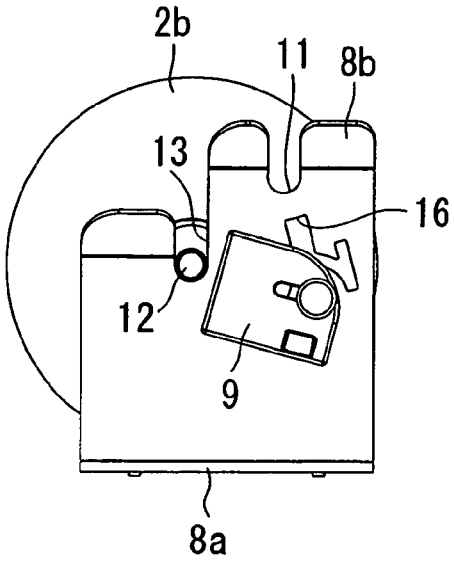
Figure 3B:
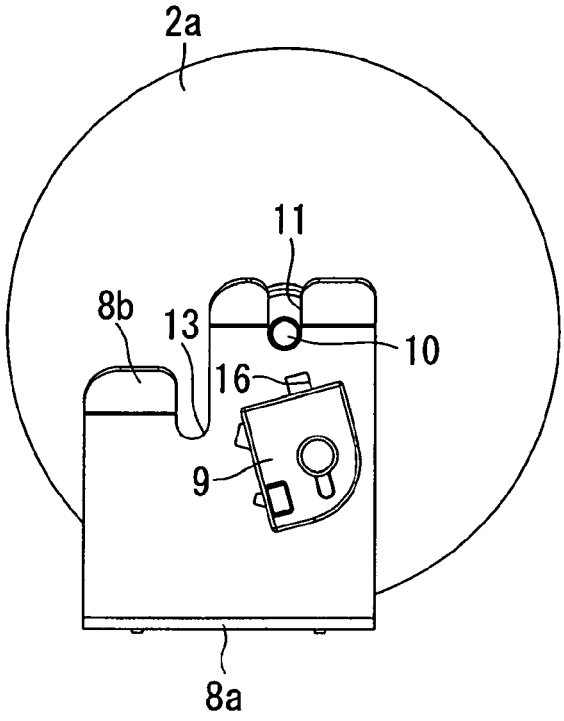
Figure 3C:
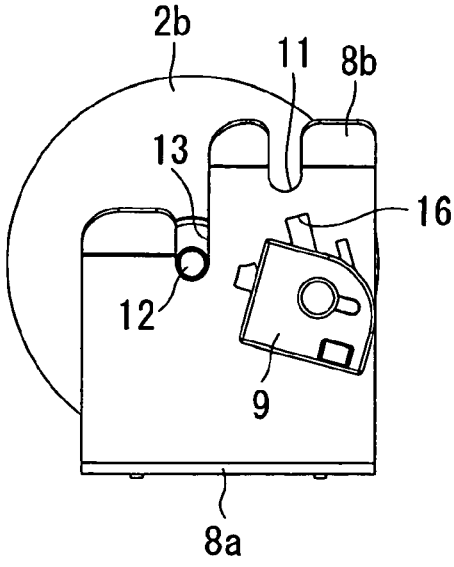
Figure 3D:
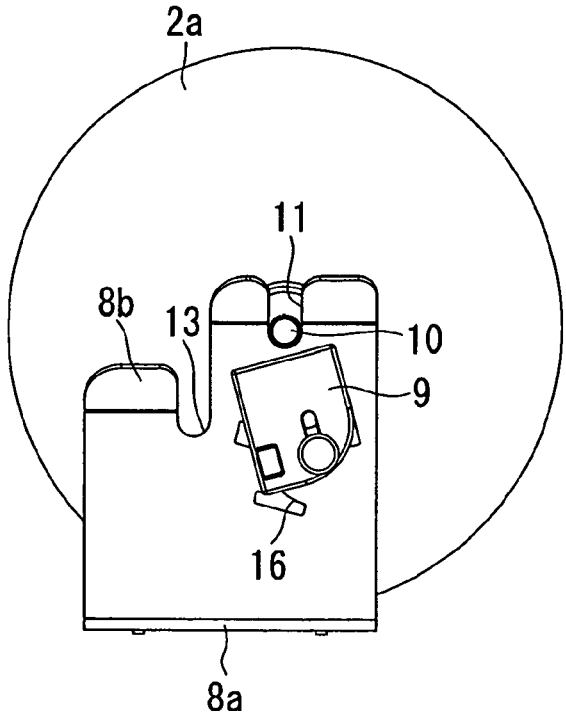

FIG. 1 is a side view of a printer provided with the paper feeding device according to this embodiment. FIGS. 2A-2D are views of one side plate of the paper feeding device when seen from a back side. FIGS. 3A-3D are views of the one side plate of the paper feeding device illustrated in FIG. 1 when seen from a front side.

As illustrated in FIG. 1, a printer 1 includes a printing device 4 that prints various kinds of information on a thermal printing layer of s sheet of a paper roll (thermal paper, for example) 2*a* (2*b*) fed from a paper feeding device 3 in a conveying direction of the sheet of the paper roll 2*a* (2*b*), a cutting device (paper cutting device) 5 that cuts the sheet of the paper roll 2*a* (2*b*) printed by the printing device 4, and a paper discharging device 6 that takes out (discharges) the sheet of the paper roll 2*a* (2*b*) cut by the cutting device 5 from a bezel (paper outlet) (not shown).

The printing device 4 is a so-called thermal printer, and has a thermal head for heating the thermal printing layer of the sheet of the paper roll 2*a* (2*b*) and a platen roller (not shown) pressed to the thermal head. The printing device 4 performs printing while pinching the sheet of the paper roll 2*a* (2*b*) fed from the paper feeding device 3 between the thermal head and the platen roller, and conveys the same.

The cutting device 5 has, for example, a pair of disk-like rotating blades (not shown) for cutting the sheet of the paper roll 2*a* (2*b*) taken out from the printing device 4 to a desired length, and conveys the cut sheet of the paper roll 2*a* (2*b*) to the paper discharging device 6.

Further, the paper feeding device 3, the printing device 4, the cutting device 5, and the paper discharging device 6 are combined through a main body frame 7.

As illustrated in FIG. 1, the paper feeding device 3 according to this embodiment includes a paper holder 8 and a near end sensor 9.

The paper holder 8 has a bottom plate 8*a* having a substantially rectangular shape in plan view extending in the conveying direction and a width direction of the sheet of the paper roll 2*a* (2*b*), and two upstanding side plates 8*b* extending upward in a vertical direction from side edges of the bottom plate 8*a*.

On each side plate 8*b* of the paper holder 8 there are provided, for example, a first notch 11 which is set to a center portion of the paper roll 2*a* having 6 inches diameter and bearing-supports a rotating shaft 10 rotating together with the paper roll 2*a*, and, for example, a second notch 13 which is set to a center portion of the paper roll 2*b* having 4 inches diameter and bearing-supports a rotating shaft 12 rotating together with the paper roll 2*b*. The first notch 11 and the second notch 13 are formed such that a front end (end portion on the printing device 4 side) 14 of an outer peripheral surface of the unused (new) paper roll 2*a* having 6 inches diameter when the paper roll 2*a* is set to the first notch 11 through the rotating shaft 10, and a front end (end portion on the printing device 4 side) 15 of an outer peripheral surface of the unused (new) paper roll 2*b* having 4 inches diameter when the paper roll 2*b* is set to the second notch 13 through the rotating shaft 12 are positioned in the same vertical plane.

Further, grooves 16 are provided on one side plate 8*b* of the paper holder 8 (near-side side plate 8*b* in FIG. 1, in this embodiment). The grooves 16 slideably guide two protrusions 9*a* protruding from a back surface of the near end sensor 9 (inner-side surface in FIG. 1) and serve as openings which are required for a sensor portion 9*b* arranged on the back surface of the near end sensor 9 to detect a remaining amount of the paper roll 2*a* (2*b*), i.e., when the paper rolls are nearly used up. The grooves 16 comprise an arcuate groove and two radial grooves connected to and extending radially outwardly from the arcuate groove. The grooves 16 are formed such that a distance between the sensor portion 9*b* of the near end sensor 9 and a rotation center of the rotating shaft 12 when the near end sensor 9 is brought closest to the rotating shaft 12 set to the second notch 13 (see, FIGS. 2A and 3A) and a distance between the sensor portion 9*b* of the near end sensor 9 and a rotation center of the rotating shaft 10 when the near end sensor 9 is brought closest to the rotating shaft 10 set to the first notch 11 (see, FIGS. 2D and 3D) are equal. The grooves 16 are also formed such that a distance between the sensor portion 9*b* of the near end sensor 9 and the rotation center of the rotating shaft 12 when the near end sensor 9 is furthest away from the rotating shaft 12 set to the second notch 13 (see, FIGS. 2B and 3B) and a distance between the sensor portion 9*b* of the near end sensor 9 and the rotation center of the rotating shaft 10 when the near end sensor 9 is furthest away from the rotating shaft 10 set to the first notch 11 (see, FIGS. 2C and 3C) are equal. Further, the grooves 16 can slide the near end sensor 9 along the one side plate 8*b* between a position illustrated in FIGS. 2A and 3A and a position illustrated in FIGS. 2B and 3B, and can slide the near end sensor 9 along the one side plate 8*b* between a position illustrated in FIGS. 2C and 3C and a position illustrated in FIGS. 2D and 3D. Moreover, the grooves 16 are formed to be capable of rotating the near end sensor 9 along the one side plate 8*b* between the position illustrated in FIGS. 2B and 3B and the position illustrated in FIGS. 2C and 3C.

In the paper feeding device 3 according to this embodiment, the first notch 11 and the second notch 13 are provided on each side plate 8*b* of the paper holder 8, and hence any one of the two paper rolls 2*a*, 2*b* having the different diameters in the unused (new) state is mounted freely according to a choice of a user, whereby it is possible to increase the convenience for a user.

Further, when the paper roll 2*a* having 6 inches diameter or the paper roll 2*b* having 4 inches diameter in the unused state is mounted to the first notch 11 or the second notch 13, the first notch 11 and the second notch 13 are formed such that the front ends 14, 15 of the outer peripheral surface of the paper rolls 2*a*, 2*b* are positioned in the same vertical plane, whereby it is possible to stably feed a paper sheet to the printing device 4 in the case of using any one of the paper rolls 2*a*, 2*b*.

Moreover, in the paper feeding device 3 according to this embodiment, the grooves 16 are provided on the one side plate 8*b* of the paper holder 8. Accordingly, a user can set the near end sensor 9 in a desired position easily and rapidly in accordance with the diameter of the paper roll 2*a* (2*b*) selected appropriately as needed.

Note that, adjusting the position of the near end sensor 9 can be performed by merely being slid or rotated along the groove 16, and hence anyone can perform easily.

On the other hand, a manufacturer which manufactures and sells the paper feeding device does not need to prepare paper holders corresponding to respective paper rolls having the different diameters in the unused state, and hence the number of components can be reduced. Further, it is possible to reduce the manufacturing cost and to realize the simplification of parts control.

The printer 1 provided with the paper feeding device 3 according to the present invention includes the paper feeding device 3 which can mount the paper rolls 2*a*, 2*b* having the different diameters in the unused (new) state freely according to the choice of a user, whereby it is possible to increase the convenience for a user.

Note that, the present invention is not limited to the embodiment as described above, and variation or modification can be effected appropriately as needed without departing from the technical idea of the present invention. For example, while in the above-mentioned embodiment, the paper holder 8 which can hold the paper roll 2*a* having 6 inches diameter or the paper roll 2*b* having inches diameter is described as a specific example, the present invention is not limited thereto. The paper holder 8 may hold a paper roll having 8 inches diameter or a paper roll having 4 inches diameter, the paper roll having 8 inches diameter or a paper roll having 6 inches diameter, or the paper roll having 8 inches diameter, the paper roll having 6 inches diameter, or the paper roll having 4 inches diameter.

What is claimed is:

1. A paper feeding device that feeds a sheet of a paper roll to a printing device, comprising:

two side plates vertically arranged along both sides of the paper roll;

a plurality of notches formed in each of the two side plates and which are capable of bearing-supporting paper rolls having different diameters in an unused state;

a near end sensor for detecting a remaining amount of the paper roll; and a groove formed in one of the two side plates and in which the near end sensor is slidably disposed to undergo slidable movement in a radial direction of the paper rolls bearing-supported by the notches of the two side plates, the groove comprising a plurality of first grooves and a second groove connecting the plurality of first grooves, the plurality of first grooves being formed such that distances between rotation centers of the paper rolls and a sensor portion of the near end sensor are the same when the near end sensor is brought closest to the rotation centers of the paper rolls, and the distances between the rotation centers of the paper rolls and the sensor portion of the near end sensor are the same when the near end sensor is furthest away from the rotation centers of the paper rolls, and the second groove being formed such that the near end sensor rotates along the side plate and changes direction as it slides along the second groove.

2. A printer having the paper feeding device according to claim 1.

3. A paper feeding device according to claim 1; wherein, when the notches are mounted with corresponding paper rolls in the unused state, end portions of outer peripheral surfaces of the paper rolls on a printing device side are arranged to be positioned in substantially the same vertical plane.

4. A printer having the paper feeding device according to claim 3.

5. A paper feeding device for feeding paper from paper rolls having different diameters in an unused state to a printing device, the paper feeding device comprising:

two upstanding side plates spaced apart from one another in opposed relationship, the two side plates having opposed first notches for rotatably bearing-supporting a first paper roll and opposed second notches for rotatably bearing-supporting a second paper roll that has a different diameter in an unused state from that of the first paper roll; and a near end sensor slidable in a groove formed in one of the side plates between a first position to detect when a first paper roll bearing-supported in the first notches is nearly used up and a second position to detect when a second paper roll bearing-supported in the second notches is nearly used up.

6. A paper feeding device according to claim 5; wherein the first notches are positioned relative to the second notches such that a point on the outer peripheral surfaces of each of the first and second paper rolls on a printing device side lie in substantially the same vertical plane.

7. A paper feeding device according to claim 5; wherein the groove has an arcuate groove and two radial grooves extending radially outwardly from the arcuate groove towards inner ends of respective ones of the first and second notches, the two radial grooves defining the first and second positions of the near end sensor.

8. A printer having the paper feeding device according to claim 7.

9. A printer having the paper feeding device according to claim 5.

* * * * *